US011911648B2

(12) United States Patent
Dickstein et al.

(10) Patent No.: US 11,911,648 B2
(45) Date of Patent: Feb. 27, 2024

(54) DUMBBELL HOLDER FOR EXERCISE BAR

(71) Applicants: Adam Dickstein, Scarsdale, NY (US); Glenn Dickstein, Scarsdale, NY (US); Roy Kushner, Dobbs Ferry, NY (US)

(72) Inventors: Adam Dickstein, Scarsdale, NY (US); Glenn Dickstein, Scarsdale, NY (US); Roy Kushner, Dobbs Ferry, NY (US)

( * ) Notice: Subject to any disclaimer, the term of this patent is extended or adjusted under 35 U.S.C. 154(b) by 7 days.

(21) Appl. No.: 17/727,719

(22) Filed: Apr. 23, 2022

(65) Prior Publication Data

US 2022/0339487 A1 Oct. 27, 2022

Related U.S. Application Data

(60) Provisional application No. 63/179,171, filed on Apr. 23, 2021.

(51) Int. Cl.
*A63B 21/072* (2006.01)

(52) U.S. Cl.
CPC ..... *A63B 21/0728* (2013.01); *A63B 21/0722* (2015.10)

(58) Field of Classification Search
CPC ..... A63B 21/0728; A63B 21/0722; A63B 21/072; A63B 21/0724; A63B 21/0726; A63B 21/075; A63B 2244/09
See application file for complete search history.

(56) References Cited

U.S. PATENT DOCUMENTS

| | | | | |
|---|---|---|---|---|
| 4,429,886 | A * | 2/1984 | Buttner | F16L 41/088 277/606 |
| 5,496,243 | A * | 3/1996 | Allen | A63B 21/0601 482/106 |
| 7,081,072 | B2 * | 7/2006 | Allen | A63B 21/0722 285/133.11 |
| 7,789,814 | B1 | 11/2010 | Xu | |
| 8,267,841 | B1 * | 9/2012 | Allison | A63B 21/075 482/106 |
| 9,126,079 | B2 * | 9/2015 | Jordan | A63B 21/072 |
| 9,149,680 | B2 * | 10/2015 | Thompson | A63B 21/072 |
| 9,566,487 | B2 * | 2/2017 | Feehan | A63B 60/22 |
| 10,086,225 | B2 | 10/2018 | Sheppard et al. | |
| D881,302 | S | 4/2020 | Greene | |
| 10,610,721 | B2 * | 4/2020 | McCall | A63B 21/0722 |
| 11,179,588 | B2 * | 11/2021 | McCall | A63B 1/00 |
| 2011/0173778 | A1 * | 7/2011 | Wales | B25G 3/20 16/426 |
| 2011/0177922 | A1 * | 7/2011 | Selinger | A63B 21/0724 482/107 |
| 2014/0024506 | A1 * | 1/2014 | Vixathep | A63B 21/072 482/108 |
| 2022/0355153 | A1 * | 11/2022 | Abbott | A63B 21/0722 |

* cited by examiner

*Primary Examiner* — Megan Anderson
*Assistant Examiner* — Kathleen M Fisk
(74) *Attorney, Agent, or Firm* — Calderon Safran & Cole, P.C.

(57) ABSTRACT

A bottom-hinged dumbbell holder may include a pair of opposed holding bodies connected along their bottoms. In a closed position, the top sections may be axially aligned and constructed and arranged to slide over an elongated bar and the bases define a generally cylindrical channel, near the hinged bottom, in which compressible gaskets and a handle of a dumbbell may be received and securely contained.

18 Claims, 13 Drawing Sheets

DUMBBELL HOLDER FOR EXERCISE BAR

CROSS-REFERENCE TO RELATED APPLICATIONS

This application claims the benefit of U.S. Provisional Application No. 63/179,171 filed Apr. 23, 2021.

FIELD OF THE DISCLOSURE

This application relates generally to physical training devices and to a dumbbell holder assembly for releasably mounting at least one dumbbell to an elongated bar

BACKGROUND OF DISCLOSURE

Free weights are commonly used for exercise. One example of a free weight is a dumbbell. A dumbbell has a narrow handle which is designed for a one-handed grip. Because dumbbells are designed for one hand, they are often used in pairs with a matching weight being held in each hand. In contrast, a barbell is usually an elongated bar designed for use with two hands. Barbells will usually accept a circular weight having a hole in the center designed to slide onto each end of the elongated bar.

Free weights, with the help of specialized benches and simple mechanical devices, can be used to develop virtually every muscle in the body. Free weights typically include a weighted barbell with collars, disc-like weight plates having standardized weights such as 2½, 5, 10, 25, 35 and 45 pounds, and pairs of dumbbells of assorted weights such as 5, 10, 25, 35 and 45 pounds per dumbbell. Although barbells may be useful for some kinds of muscle development exercises, dumbbells are preferred for others. In many cases, dumbbell type exercises simply cannot be performed with a barbell, and, often, barbell type exercises cannot be performed with dumbbells.

Therefore, consumers are faced with the prospect of purchasing a barbell and a complete set of barbell weight plates, and also a complete dumbbell set in order to have an adequate free weight training facility which becomes costly and takes up valuable space. Since space is always at a premium and purchasers generally wish to get the most versatile weight device for their money, home gym users interested in free weights are often faced with a dilemma as to whether to acquire a barbell and a set of weight plates for the barbell or, in the alternative, a set of dumbbells.

SUMMARY OF THE INVENTION

The present disclosure may include a simple way to removably secure a dumbbell to a barbell or barbells in order to use the dumbbell as a removable weight for exercises performed with a barbell. The device is designed to be easy to use, to securely grip the dumbbell handle, and resist unintended dislodging.

The disclosed dumbbell holder may provide a weightlifting system for reducing equipment requirements by eliminating the need for dedicated barbell weight plates. Instead, dumbbells may be constructed and arranged to be barbell weights, which allows the dumbbells to be removably attached to a barbell or barbells. The disclosed dumbbell holder can be removably attachable to any of the different lifting weight dumbbells in a set and, when more than one device and dumbbell are attached to each end of a barbell, it allows a user with a set of dumbbells to add multiple dumbbells to each end of the barbell and thus allows the user to add more weight to a barbell than any single pair of dumbbells would normally allow.

BRIEF DESCRIPTION OF THE DRAWINGS

A complete understanding of the present variations and the features thereof will be more readily understood by reference to the following detailed description when considered in conjunction with the accompanying drawings wherein.

Figure 1:
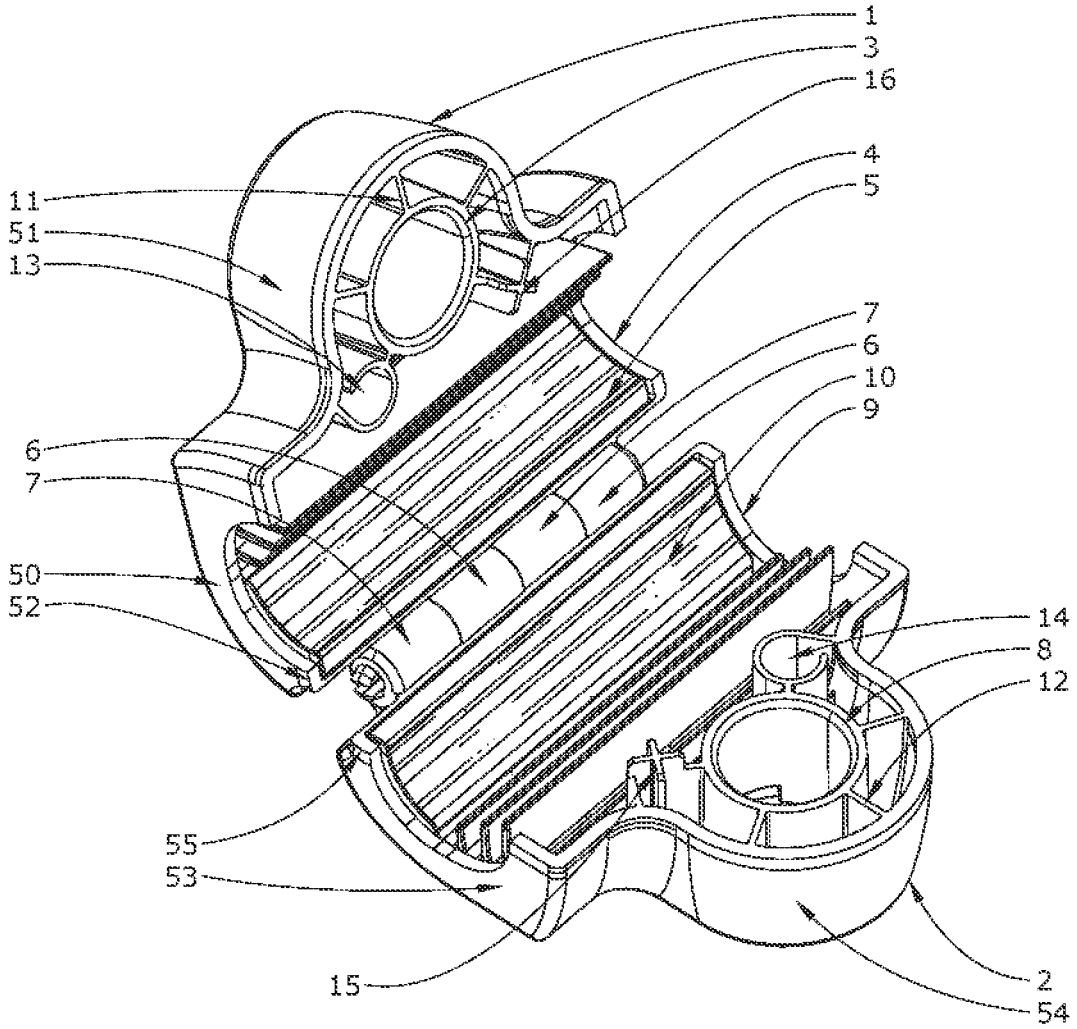
FIG. 1 shows an isometric view of the dumbbell holder in an open position.

The drawings are not necessarily to scale, and certain features and certain views of the drawings may be shown exaggerated in scale or in schematic in the interest of clarity and conciseness.

DETAILED DESCRIPTION

The specific details of the single embodiment or variety of embodiments described herein are to the described system and methods of use. Any specific details of the embodiments are used for demonstration purposes only and no unnecessary limitations or inferences are to be understood from there.

It is noted that the embodiments reside primarily in combinations of components and procedures related to the system. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the variations disclosed may include a dumbbell holder having an approximately clam shell or mirrored construction suitable for attaching dumbbells to a bar, bars, barbell, or barbells. The dumbbell holder may include a primarily two-part construction featuring a first body and second body hingedly attached to one another in order to partially enclose the handle of a dumbbell therein. The first body and second body may also define through holes for receiving a bar therein, such that the bar may be used to utilize the dumbbells in a manner similar to that of traditional barbells. The dumbbell holder may include gaskets for facilitate secure attachment of the dumbbell holder to both a dumbbell and a bar. It is also contemplated that multiple dumbbell holder may utilized together on a bar to provide more resistance. In such a case, an elongated spacer may attach multiple dumbbell holders adjacent to one another such that movement of dumbbells on a bar is minimized.

FIG. 1 shows an isometric view of one version of the dumbbell holder, in an open position. The first body 1 may have a first upper section 51 defining an elongated cylindrical through hole 3 constructed and arranged to receive at least a portion of an elongated bar or bars (for example a barbell, wooden rod, metal bar, square bar, or shaft), a first intermediate section 50 being disposed between and connecting the first upper section 51 to a first base section 52 and defining a semicircular elongated channel 4 constructed and arranged to receive a formed gasket 5 constructed and arranged to receive the elongated cylindrical grip of a dumbbell. The first base section 52 is may include a series of barrel hinge segments 6. The barrel hinge segments 6 of the first body 1 may be constructed and arranged to engage with a corresponding series of barrel hinge segments 7 on a second base section 55 of a second body 2. Alternatively, the first body and second body may be attached to one another with other hinge arrangements, such as, but not limited to, living hinges, butt hinges, butterfly hinges, flush hinges, knife hinge, mortise hinge, offset hinge, pivot hinge, or the like. The second body 2 may include a second upper section 54 with an elongated cylindrical through hole 8 constructed and arranged to receive an elongated cylindrical bar or bars (for example a barbell), a second intermediate section 53 being disposed between and connecting the second upper section 54 to the second base section 55 and having a semicircular elongated channel 9 constructed and arranged to receive a formed gasket 10 which is then constructed and arranged to receive the elongated cylindrical grip of a dumbbell. According to some variations, the two bodies 1 and 2 may be symmetrical, and the second body can be rotated about its vertical axis such that a second inside face 12 of the second body 2 will align with a first inside face 11 of the first body 1, and the barrel hinge segments of the first body 6 will engage the barrel hinge segments of the and second body 7 forming the complete holder for a dumbbell. The first inside face 11 of the first body 1 includes first formed protruding tab 16 constructed and arranged to be releasably engaged with a second formed indent 14 on the second inside face 12 of the second body 2 when the bodies are closed about the axis of the barrel hinge segments 6 and 7. The second inside face 12 of the second body 2 includes a second protruding tab 15 constructed and arranged to be releasably engaged with a first formed indent 13 on the first inside face 11 of the first body 1 when the bodies are closed about the axis of the barrel hinge segments 6 and 7. The function of the constructed and arranged formed indents and formed protruding tabs is to distribute the gravity weight of the dumbbell along multiple contact points between the first body 1 and the second body 2.

Figure 2:
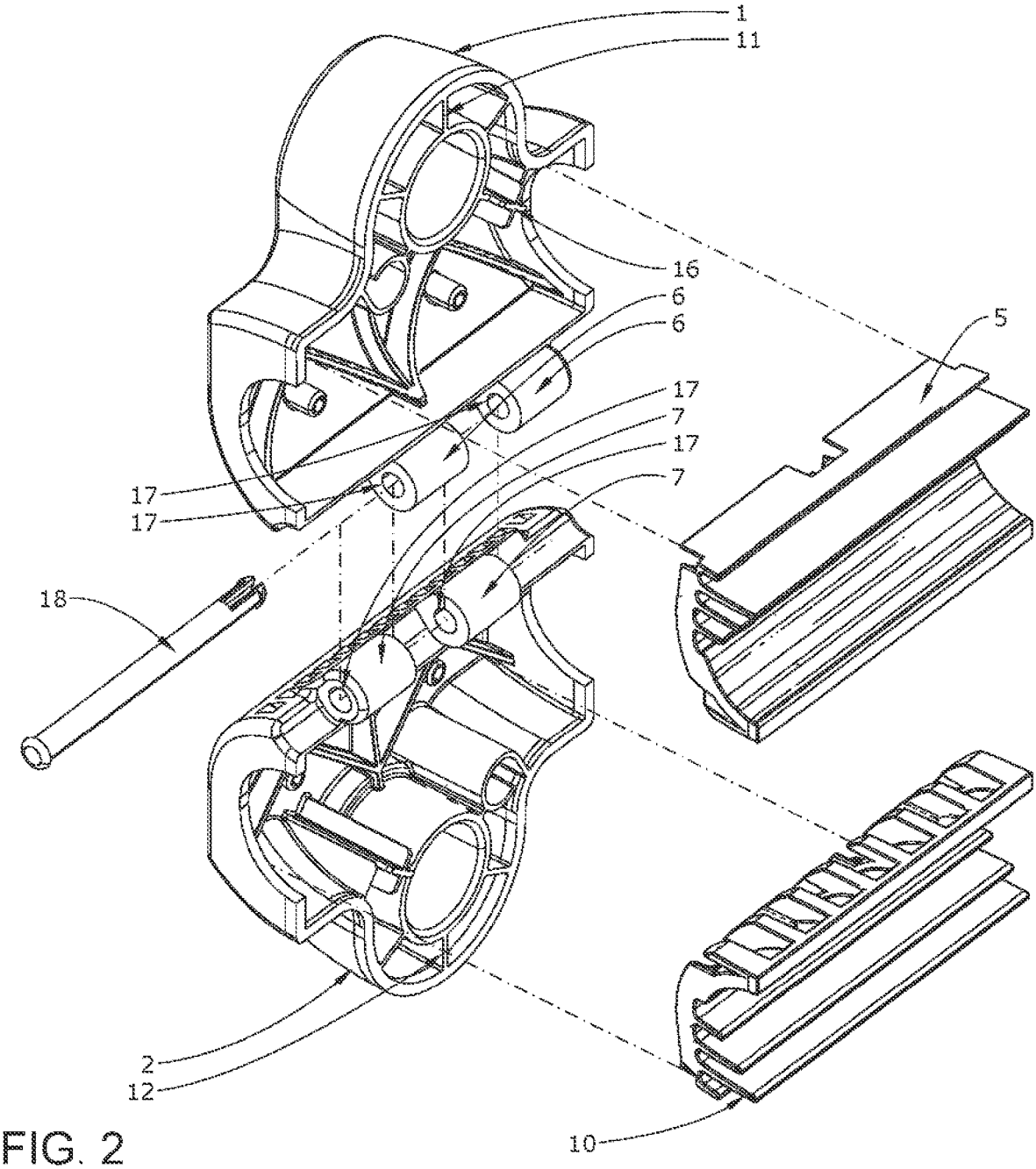
FIG. 2 shows an exploded isometric view of the dumbbell holder.
Figure 3:
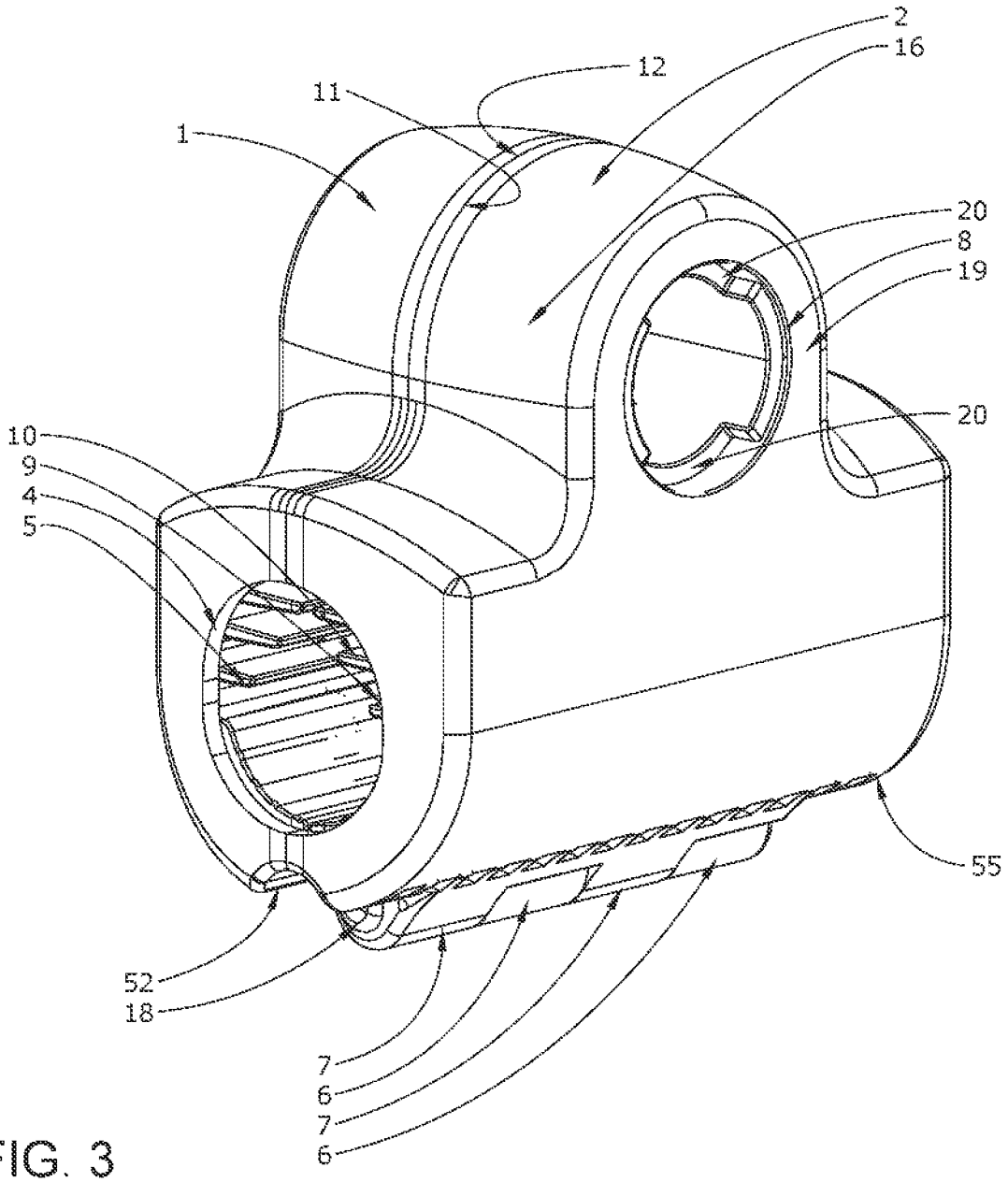
FIG. 3 shows an isometric view of the dumbbell holder in a closed position.

FIG. 2 shows how the barrel hinge segments 6 of the first body 1, and the interlocking barrel hinge segments 7 of the second body 2 may be axially aligned along the elongated cylindrical through holes 17 in order to receive and engage an elongated barrel hinge pin 18. When the elongated barrel hinge pin 18 is inserted into the elongated cylindrical through holes 17 along the barrel hinge segments 6 and 7, the engaged barrel hinge segments 6 and 7 enable a pivoting motion of the first body 1 relative to the second body 2 between a closed position and an opened position. FIG. 1 shows an open position of the dumbbell holder and FIG. 3 shows a closed position of the dumbbell holder. FIG. 2 also shows the adapted relationship between the first formed gasket 5 and the first inside face 11 of the first body 1, and the adapted relationship between the second formed gasket 10 and the second inside face 12 of the second body 2, the purpose of the formed gasket being to releasably and securely engage an elongated grip of a standard dumbbell. As best seen in FIG. 2, the second formed gasket 10 may have a rear face structure complimentary to the first inside face 11 structure of the first body 1 such that the gasket 10 and the first inside face 11 may be mechanically mated to one another. Similarly, a second gasket 13 may have a rear face structure complimentary to the second inside face 12 structure of the second body 2 such that the second gasket 13 and the second inside face 12 may be mechanically mated to one another.

FIG. 3 shows an isometric view of one version of the dumbbell holder, in a closed position. The elongated barrel hinge pin 18, is constructed and arranged to be inserted into the elongated cylindrical through holes 17 along the axis of the barrel hinges 6 and 7, thus fastening the first body 1 and second body 2 together and allowing them to rotate about the corresponding axis of the barrel hinge segments 6 and 7 and the elongated barrel hinge pin 18. The first body 1 can thus be pivoted into an open or closed position relative to the second body 2 about the axis of the elongated barrel hinge pin 18 and in the closed position, the first inside face 12 of the first body 1 abuts the second inside face 11 of second body 2. In the closed position, the abutting faces, 11 and 12 cause the semicircular elongated channel 4 constructed and arranged to receive a formed gasket 5 of the first body 1 to engage semicircular elongated channel 9 constructed and arranged to receive a formed gasket 10 of body 2 in such a manner that the semicircular channels 4 and 9 form a complete circle being constructed and arranged to receive and securely hold an elongated cylindrical handle of a dumbbell; and in the closed position FIG. 3, the dumbbell is then securely held with no ability to disengage. FIG. 3 also shows a series of formed notches 20 around the circumference of the elongated cylindrical through hole 8 on the exterior face 19 of the second body 2. In FIG. 2 there may be two notches 20 but there may be as few as one notch and as many notches as desired. In FIG. 3, the formed notches 20 around the cylindrical opening 3 of the first body 1, may be hidden from view on the opposite side, but may be identical to the formed notched described in the second body above.

Figure 4:
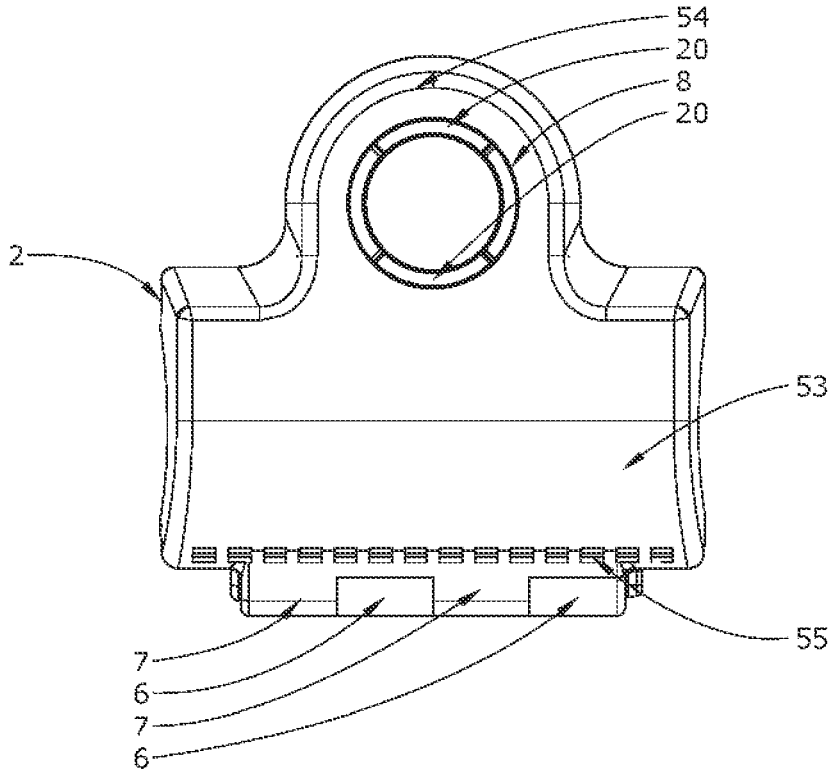
FIG. 4 shows a front view of the dumbbell holder.

FIG. 4 shows the second body 2 including the second upper section 54 with an elongated cylindrical through hole 8 constructed and arranged to receive an elongated cylindrical bar (for example a barbell), the second intermediate section 53 and the second base section 55. The second base section 55 includes of the barrel hinge segments 7 which are shown interlocked with the barrel hinge segments 6 of the first body 1. Also visible are two formed notches 20, around the elongated circular opening 8 that may be constructed and arranged to receive a formed projection 21, best seen in FIGS. 10 through 13, on the adapted face 22 or 23 of an elongated cylindrical spacer 27.

Figure 5:
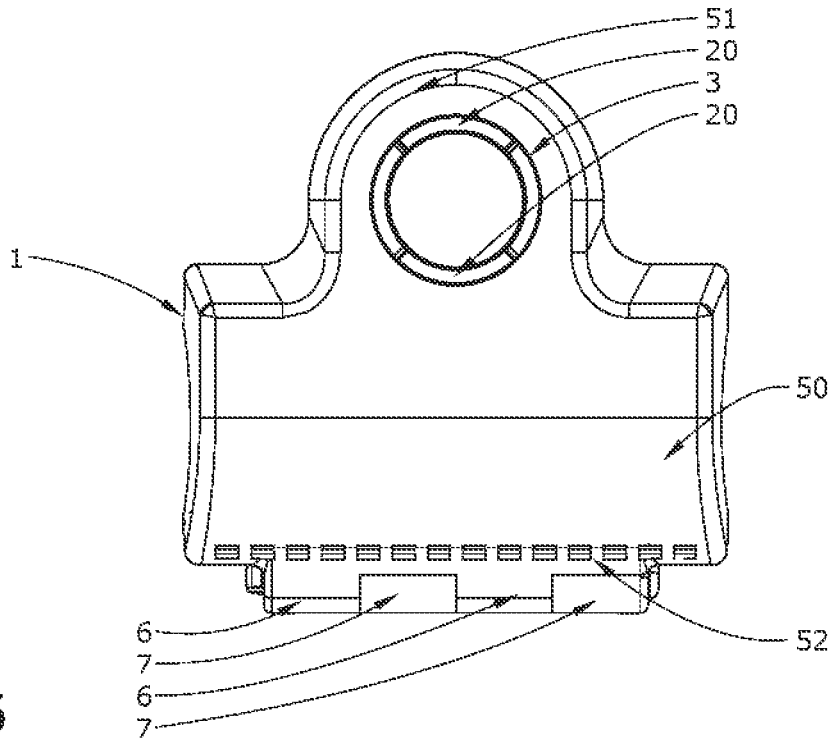
FIG. 5 shows a back view of the dumbbell holder.

FIG. 5 shows the first body 1 including a first upper section 51 with an elongated cylindrical through hole 3 constructed and arranged to receive an elongated cylindrical bar (for example a barbell), the first intermediate section 50 and the first base section 52. The first base section 52 includes of the barrel hinge segments 6 which are shown interlocked with the barrel hinge segments 7 of the second body 2. Also visible are the two formed notches 20, around the elongated circular opening 3 that may be constructed and arranged to receive one or more formed projections 21, best seen in FIGS. 10 through 13, on the adapted face 22 or 23 of the elongated cylindrical spacer 27. The elongated cylindrical spacer will be shown in FIGS. 10, 11, 12, and 13.

Figure 6:
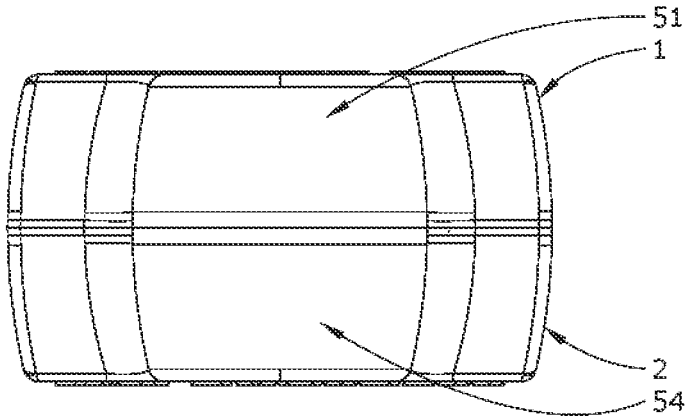
FIG. 6 shows a top view of the dumbbell holder.
Figure 7:
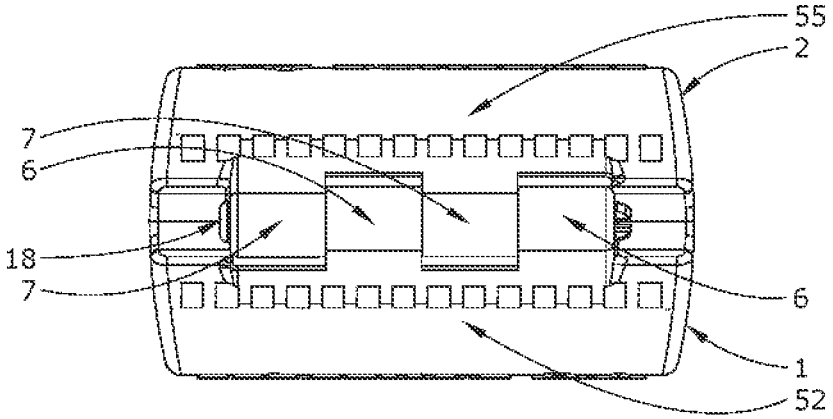
FIG. 7 shows a bottom view of the dumbbell holder.

FIG. 6 shows the upper section 51 of the first body 1 and the upper section 54 of the second body 2.

7 shows the lower section 55 of the second body 2 and the lower section 52 of the first body 1. The barrel hinge segments 6 of the first body 1 are shown interlocked with the barrel hinge segments 7 of the second body 2, and the elongated barrel hinge pin 18, is shown inserted into the elongated cylindrical through holes 17 along the axis of the barrel hinges 6 and 7, thus fastening the first body 1 and second body 2 together and allowing them to rotate about the colinear axis of the barrel hinge segments 6 and 7 and the elongated barrel hinge pin 18.

Figure 8:
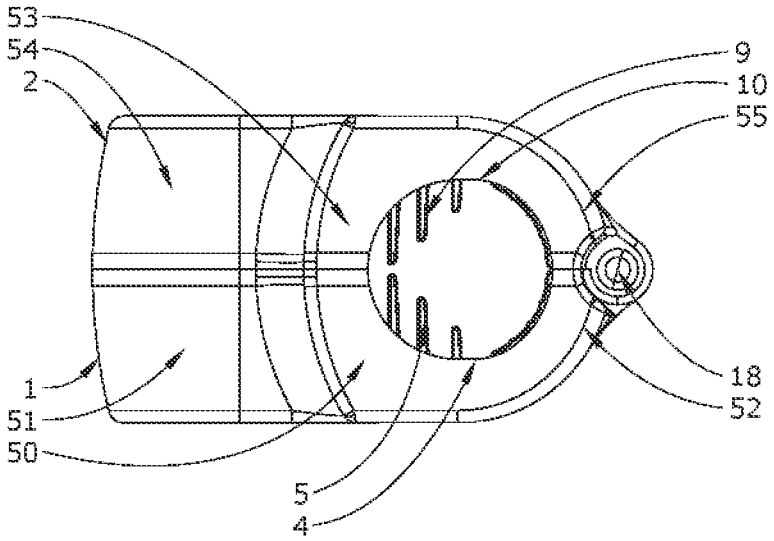
FIG. 8 shows a left-side view of the dumbbell holder.

FIG. 8 shows the first upper section 51, the first intermediate section 50 and the first base section 52 of the first body 1 and the second upper section 54, the second intermediate section 53 and the second base section 55 of the second body 2. Also shown are the elongated circular channels 4 and 9, and their constructed and arranged gaskets 5 and 10.

Figure 9:
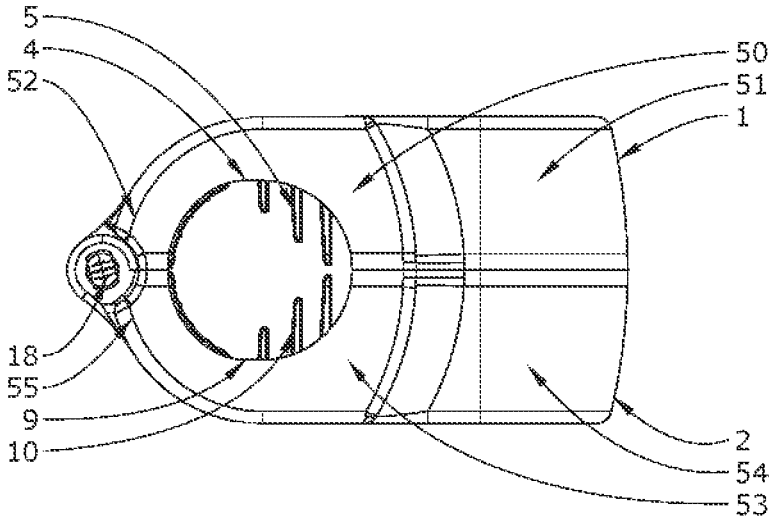
FIG. 9 shows a right-side view of the dumbbell holder.

FIG. 9 shows the mirror image of FIG. 8 with the same components labeled.

Figure 10:
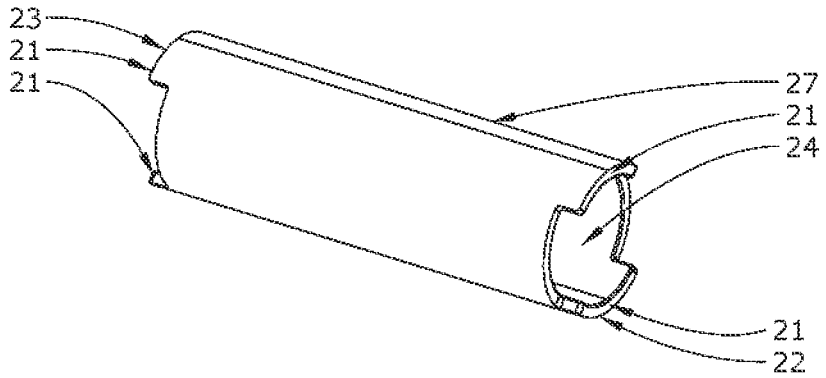
FIG. 10 shows an isometric view of the elongated cylindrical spacer.

FIG. 10 shows an elongated cylindrical spacer 27 with an elongated cylindrical through hole 24 along the same axis as the elongated cylindrical spacer 27 which is constructed and arranged to receive an elongated cylinder such as a barbell. The elongated cylindrical spacer 27 has a first end surface face 22 and a second end surface face 23, both surface faces being identical and both surfaces being perpendicular to the cylindrical axis and each surface having formed projections 21 constructed and arranged to be received in the corresponding formed notches 20 around the circumference of the elongated cylindrical through holes 3 and 8 on the first and second bodies 1 and 2. The first body 1, being identical to the second body 2, both have the same formed notches 20. The preferred embodiment of the elongated cylindrical spacer 27 has two formed notches 20 on each end surface 22 and 23. However, there may be any number of form projections 21, so long as they may be constructed and arranged to be received in corresponding formed notches 20. The purpose of the notches 20 and the formed projections 21 may be to rotationally interlock two dumbbell holders about the axis of a barbell so that when more than one dumbbell holder is used on each end of the barbell at the same time, they will swing or rotate at the same rate about the axis of the barbell.

Figure 11:
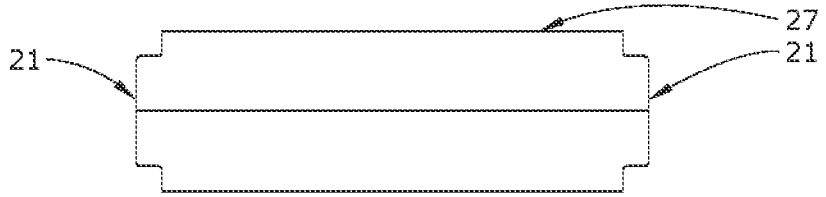
FIG. 11 shows a top view of the elongated cylindrical spacer.
Figure 12:
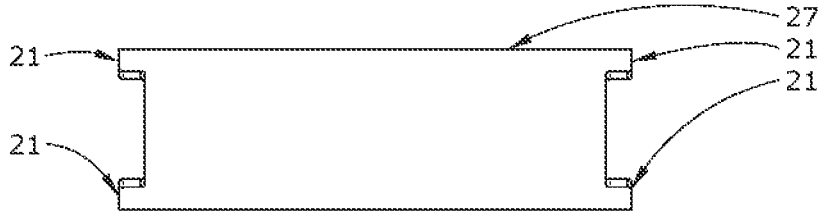
FIG. 12 shows a side view of the elongated cylindrical spacer.
Figure 13:
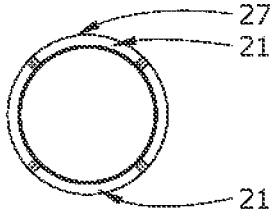
FIG. 13 shows a front view of the elongated cylindrical spacer.

FIGS. 11, 12, and 13 all show different views of the elongated cylindrical spacer 27 and the formed projections 21.

Figure 14:
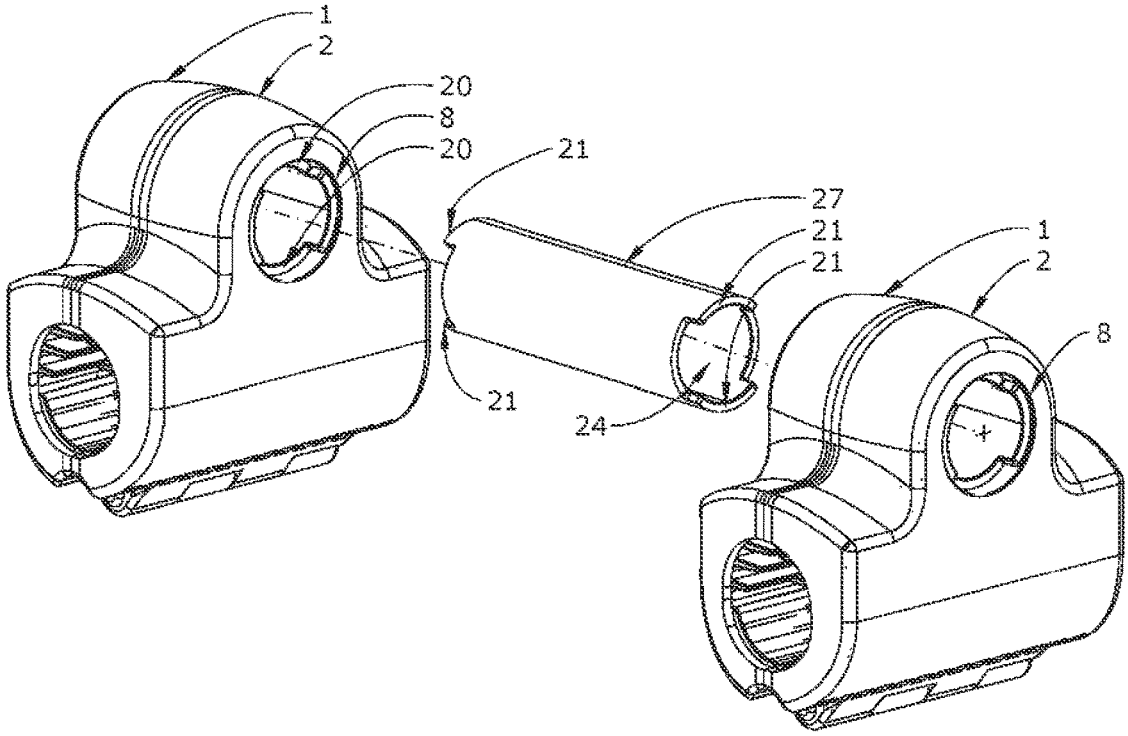
FIG. 14 shows an exploded axonometric view of two dumbbell holders with an elongated cylindrical spacer between the two dumbbell holders.

FIG. 14 shows two dumbbell holders, each having a first body 1 and a second body 2. This figure shows the axial alignment between the elongated cylindrical through holes 8 in each second body 2 and the elongated cylindrical through hole 24 of the elongated cylindrical spacer 27 all of which may be constructed and arranged to receive the elongated cylinder of a barbell therethrough. The elongated cylindrical through holes 3 in each first body may be on the back side and hidden from view in FIG. 14. The formed projections 21 of the elongated cylindrical spacer 27 may be aligned and constructed and arranged to be received in the corresponding notches 20 around the elongated cylindrical through holes 3 and 8 in each dumbbell holder. Since each body of each dumbbell holder is identical, the relationship between the formed projections 21 and the constructed and arranged notches 20 may be the same in all instances.

Figure 15:
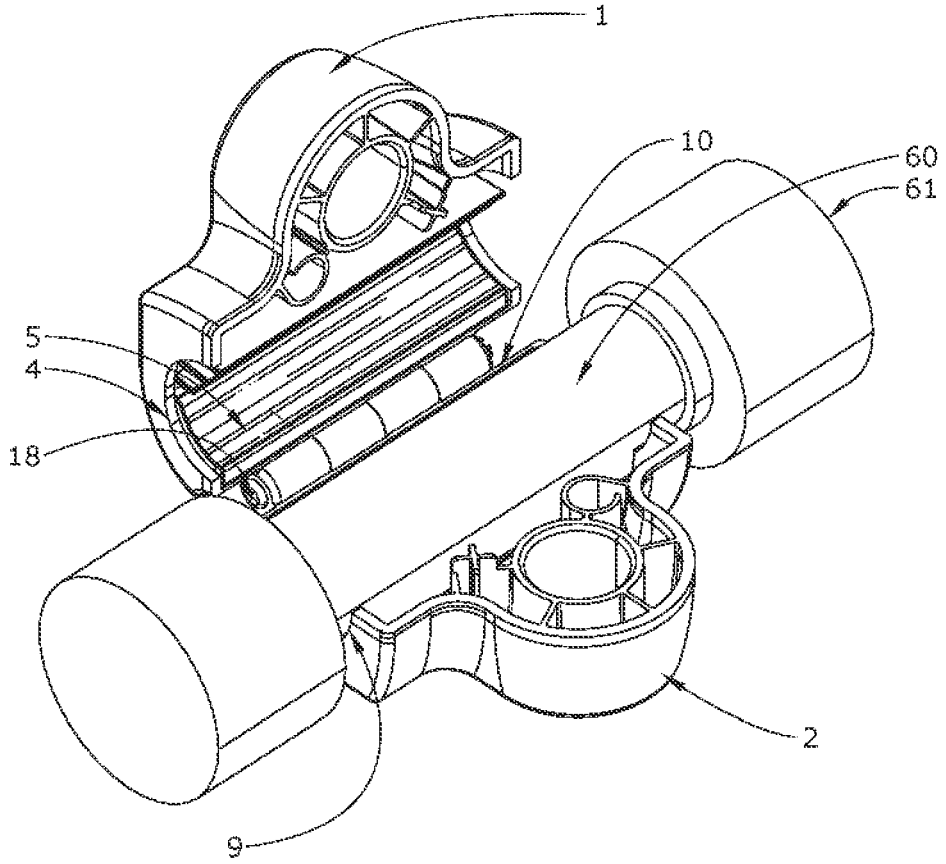
FIG. 15 shows the dumbbell holder in an open position with a standard dumbbell within the elongated cylindrical channel.

FIG. 15 shows a dumbbell holder in an open position, with an elongated grip 60 of a standard dumbbell 61 engaged onto the constructed and arranged formed gasket 10 within the semicircular elongated channel 9 of the second body 2. The formed gasket 5 within the semicircular elongated channel 4 of the first body 1 is visible and is constructed and arranged to engage the elongated grip 60 of a standard dumbbell 61 when the dumbbell is pivoted into a closed position about the axis of the elongated barrel hinge pin 18.

Figure 16:
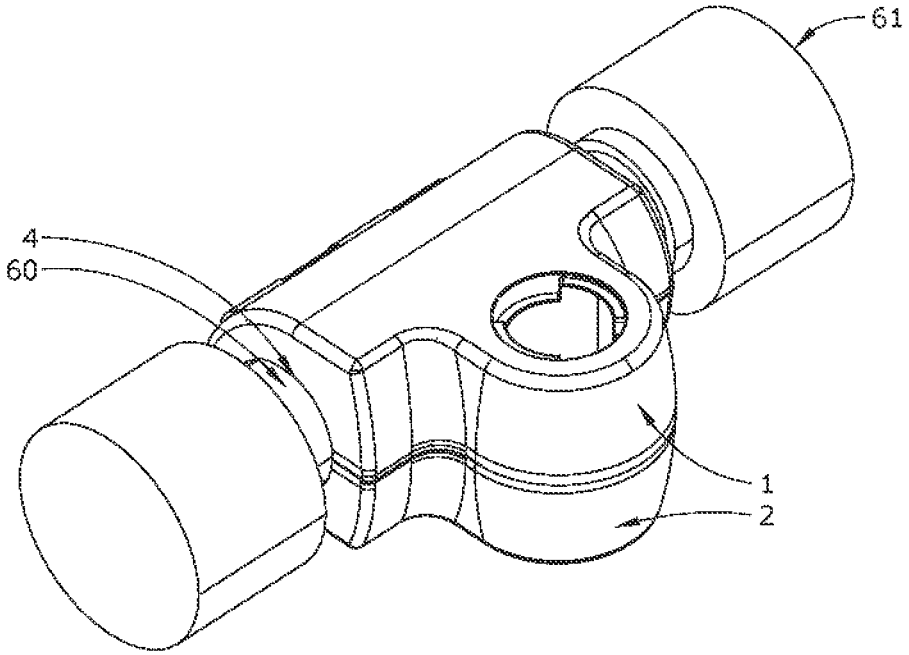
FIG. 16 shows the dumbbell holder in a closed position with a standard dumbbell within the elongated cylindrical channel.

FIG. 16 shows a dumbbell holder in a closed position with the elongated grip 60 of a standard dumbbell 61 engaged by the formed gasket 5 within the semicircular channel 4 of the first body 1 and the formed gasket 10 within the semicircular channel 9 of the second body 2 in such a manner that the semicircular channels 4 and 9 form a complete circle, thus securely engaging elongated grip 60 of a standard dumbbell 61 which then has no ability to disengage.

Figure 17:
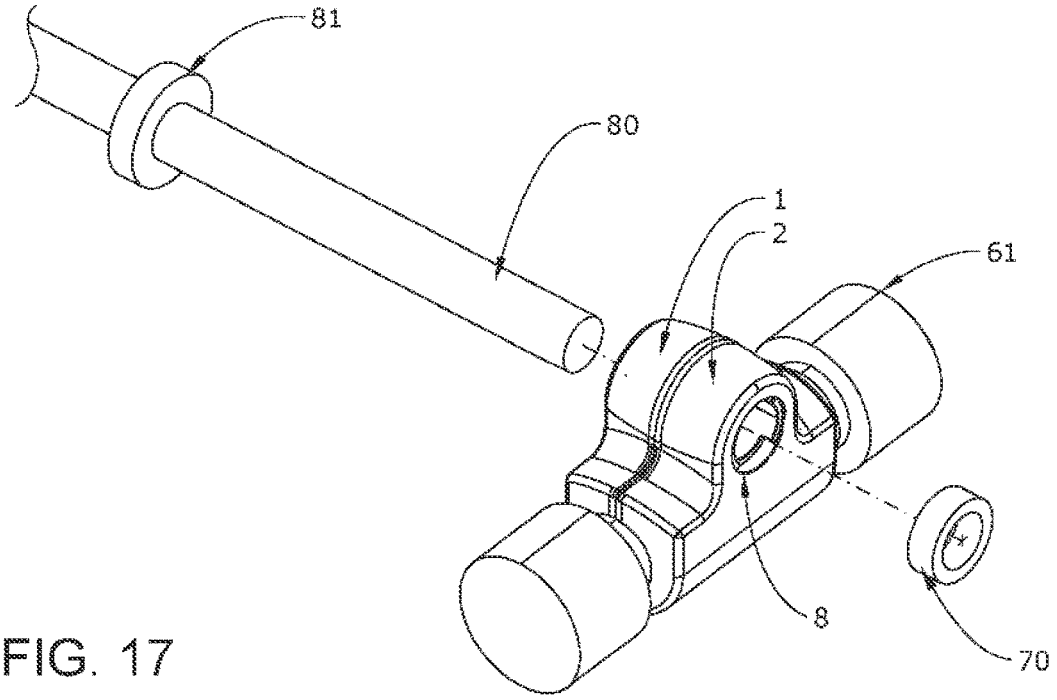
FIG. 17 shows a partial exploded isometric view of a barbell, a dumbbell holder in a closed position with a standard dumbbell engaged therein.

FIG. 17 shows an exploded isometric view of a dumbbell holder with a dumbbell 61 securely engaged therein, and a barbell. The cylindrical openings 8 (visible) and 3 (not shown) may be constructed and arranged to engage the elongated shaft of a barbell 80 and then, when a standard barbell collar 70 is placed on the end of the barbell 80 the dumbbell holder and the dumbbell are securely engaged on the barbell 80, between the fixed barbell bushing 81 and the standard barbell collar 70 and the first body 1 and the second body 2 are held closed such that the bodies are unable to rotate about the axis of the elongated hinge pin 18, and such that the dumbbell has no ability to disengage.

Figure 18:
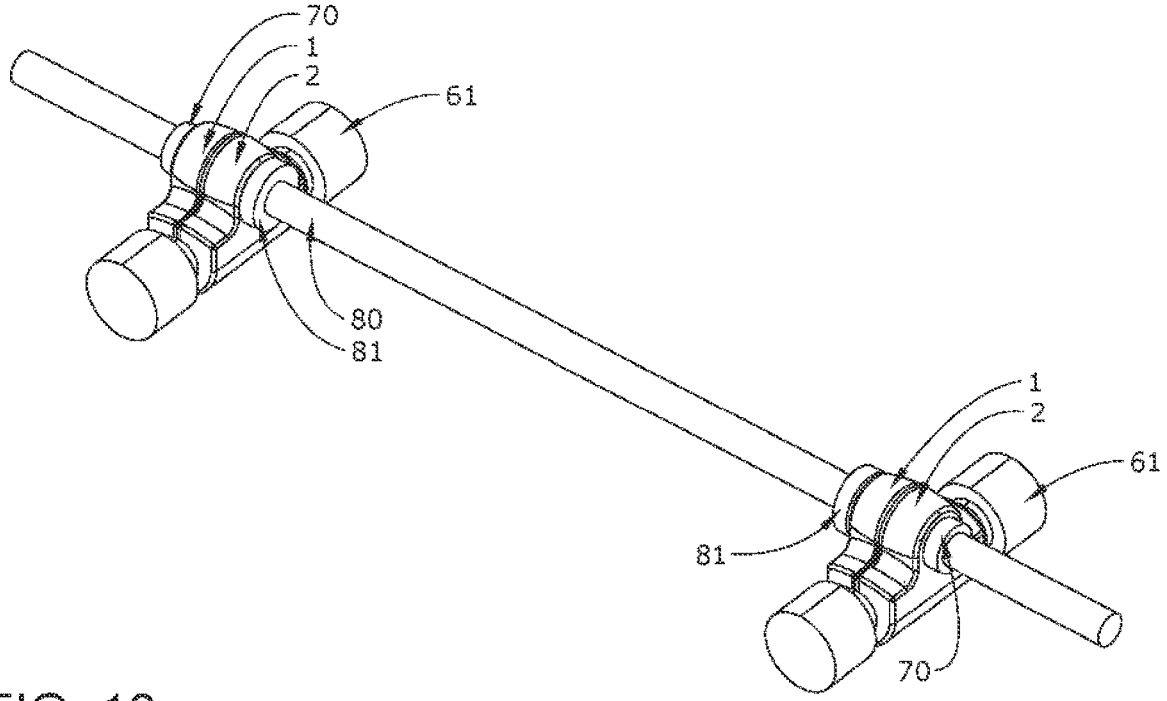
FIG. 18 shows one dumbbell holder on each end of a barbell.

FIG. 18 shows one dumbbell holder on each end of a barbell 80, each dumbbell securely engaged on the barbell, between the fixed barbell bushings 81 and the standard barbell collars 70.

Figure 19:
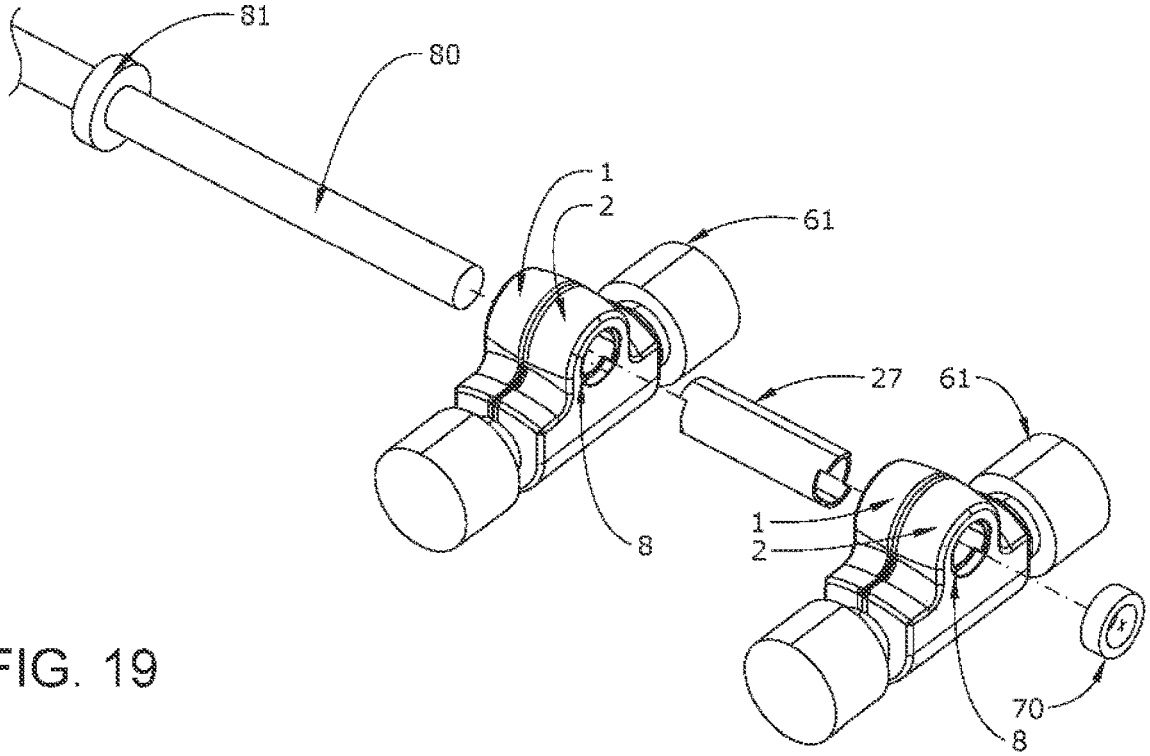
FIG. 19 shows a partial exploded isometric view of a barbell, two dumbbell holders, each in a closed position and each with a standard dumbbell engaged therein.

FIG. 19 shows an exploded isometric view of two dumbbell holders each with a dumbbell 61 securely engaged therein, an elongated cylindrical spacer 27, a barbell 80 with a fixed barbell bushing 81, and a standard barbell collar 70. The cylindrical openings 8 and 3 (not shown) may be constructed and arranged to engage the elongated shaft of the barbell 80, the elongated cylindrical spacer 27 is constructed and arranged to engage the elongated shaft of the barbell 80 and then, when a standard barbell collar 70 is placed on the end of the barbell 80, the two dumbbell holders each with the dumbbells 61 securely engaged therein and separated by the elongated cylindrical spacer 27 between may be securely engaged on the barbell 80, between the fixed barbell bushing 81 and the standard barbell collar 70 and all the first bodies 1 and the second bodies 2 may be held closed such that the bodies may be unable to rotate about the axis of the elongated hinge pin 18, and such that the dumbbell has no ability to disengage.

Figure 20:
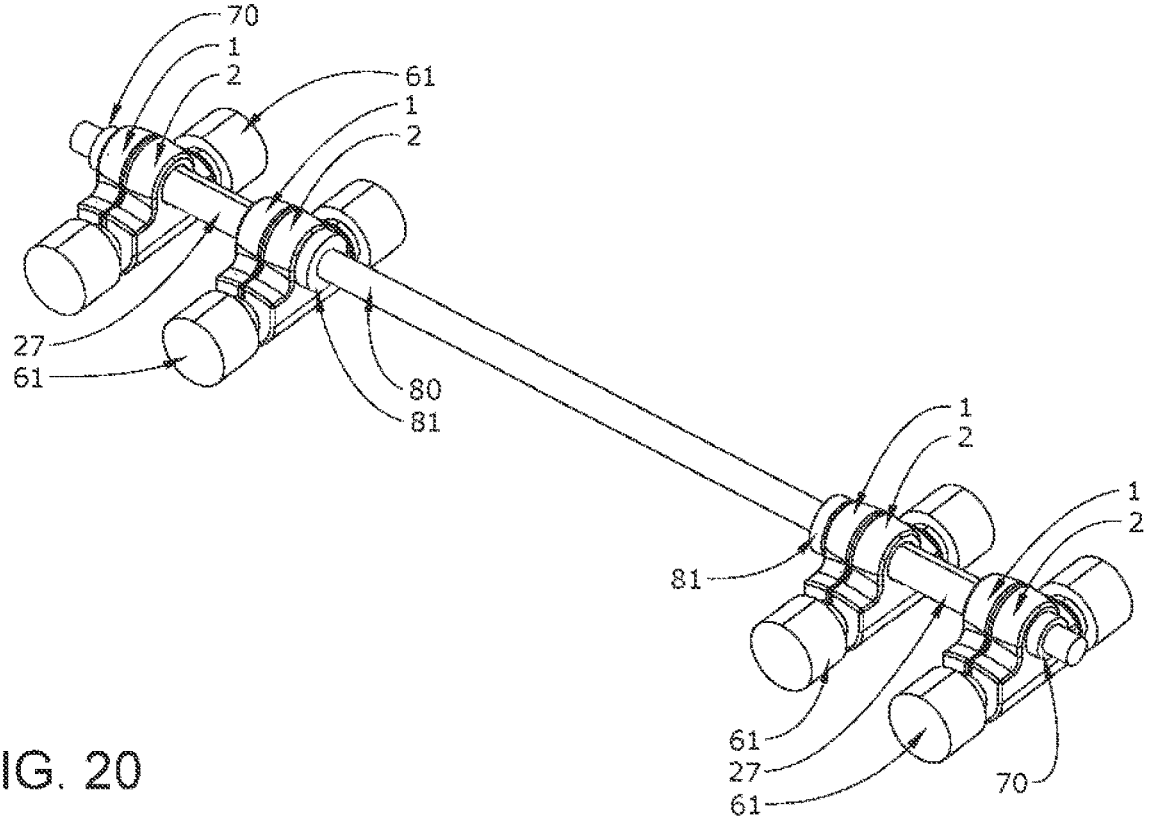
FIG. 20 shows two dumbbell holders on each end of a barbell.

FIG. 20 shows two dumbbell holders on each end of a barbell 80, an elongated cylindrical spacer 27 between each dumbbell holder, all securely engaged on the barbell, between the fixed barbell bushings 81 and the standard barbell collars 70.

Figure 21:
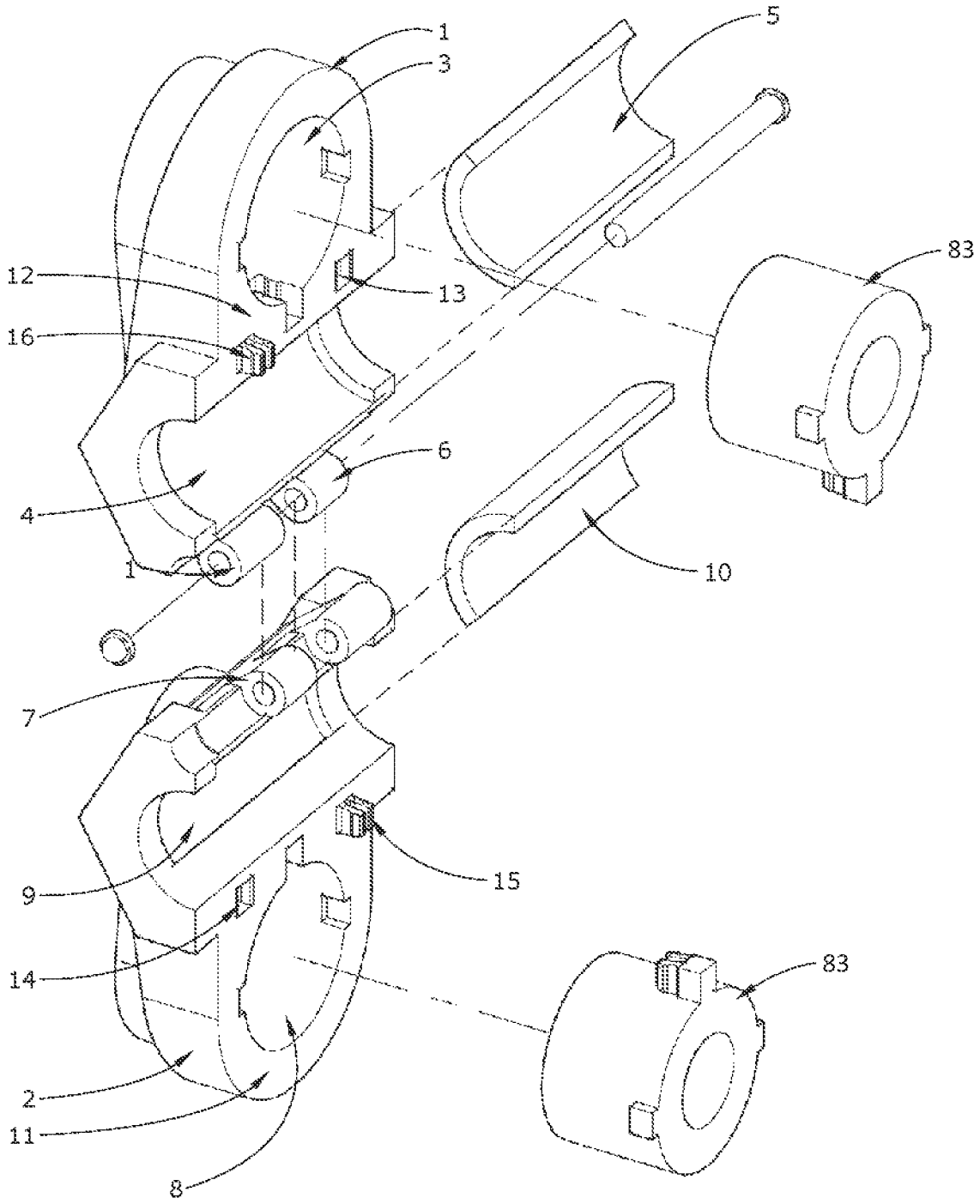
FIG. 21 shows an isometric exploded view of the dumbbell holder in an open position including an insert.

FIG. 21 shows an isometric exploded view of the dumbbell holder in an open position including an insert 83. The first body 1 may have a first upper section defining an elongated cylindrical through hole 3 constructed and arranged to receive at least a portion of an elongated bar (for example a barbell, wooden rod, metal bar, square bar, or shaft), a first intermediate section being disposed between and connecting the first upper section to a first base section and defining a semicircular elongated channel 4 constructed and arranged to receive a formed gasket 5 constructed and arranged to receive the elongated cylindrical grip of a dumbbell. The first base section may include a series of barrel hinge segments 6. The barrel hinge segments 6 of the first body 1 may be constructed and arranged to engage with a corresponding series of barrel hinge segments 7 on a second base section of a second body 2. The second body 2 may include a second upper section with an elongated cylindrical through hole 8 constructed and arranged to receive an elongated cylindrical bar (for example a barbell), a second intermediate section being disposed between and connecting the second upper section to the second base section and having a semicircular elongated channel 9 constructed and arranged to receive a formed gasket 10 which is then constructed and arranged to receive the elongated cylindrical grip of a dumbbell. According to some embodiments, the elongated cylindrical through hole 3 and the second elongated cylindrical through hole 8 may be constructed and arranged to receive one or more inserts 83 to adapt the through holes 3 and 8 for receiving elongated bars of various diameters, shapes, or sizes. According to some variations, the two bodies 1 and 2 may be symmetrical, and the second body can be rotated about its vertical axis such that a second inside face 11 of the second body 2 will align with a first inside face 12 of the first body 1, and the barrel hinge segments of the first body 6 will engage the barrel hinge segments of the and second body 7 forming the complete holder for a dumbbell. The first inside face 12 of the first body 1 includes first formed protruding tab 16 constructed and arranged to be releasably engaged with a second formed indent 14 on the second inside face 11 of the second body 2 when the bodies are closed about the axis of the barrel hinge segments 6 and 7. The second inside face 11 of the second body 2 includes a second protruding tab 15 constructed and arranged to be releasably engaged with a first formed indent 13 on the first inside face 12 of the first body 1 when the bodies are closed about the axis of the barrel hinge segments 6 and 7. The function of the adapted formed indents and formed protruding tabs is to distribute the gravity weight of the dumbbell along multiple contact points between the first body 1 and the second body 2.

Figure 22:
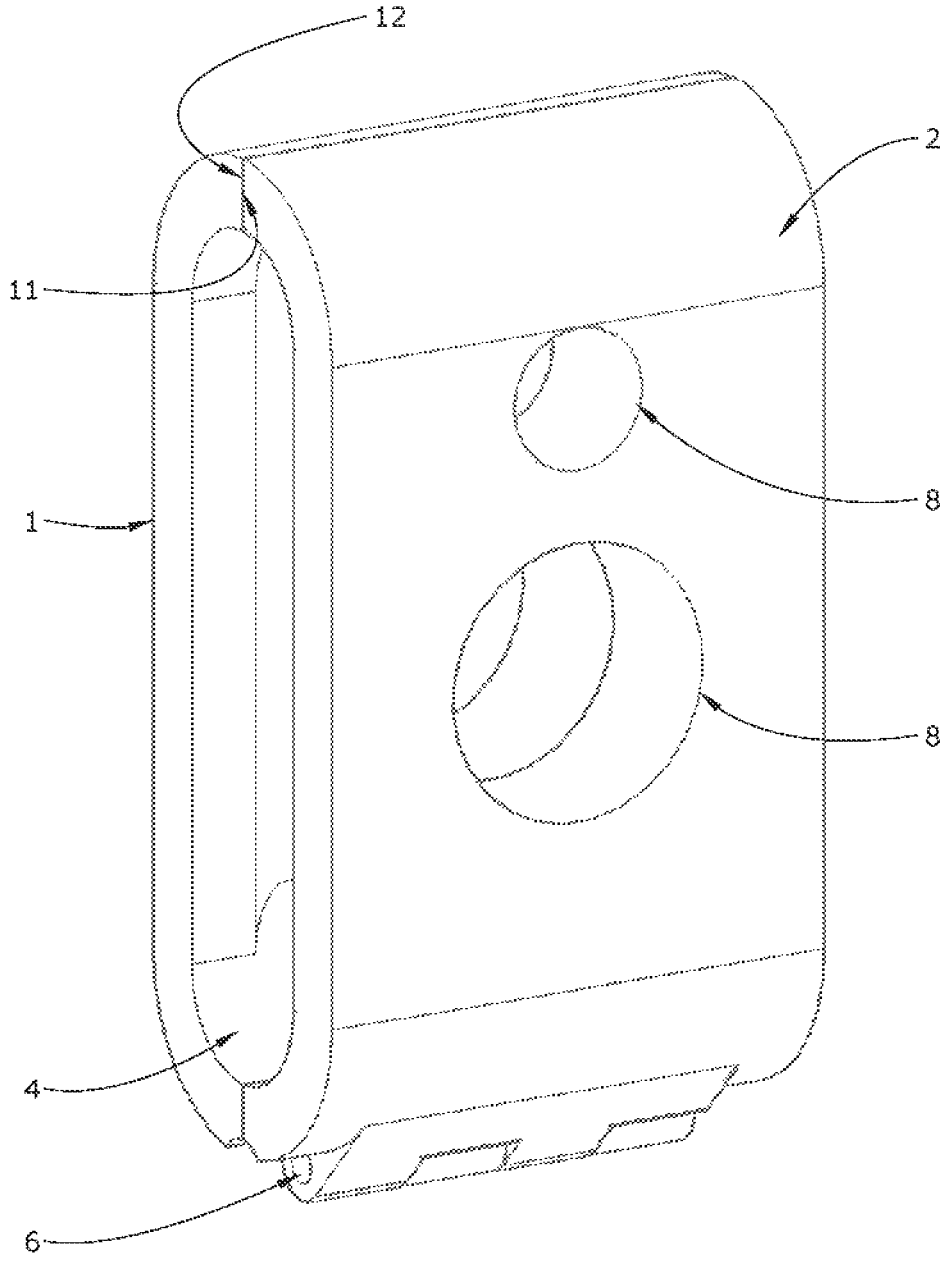
FIG. 22 shows an isometric view of the dumbbell holder in a closed position.

FIG. 22 shows an isometric view of one version of the dumbbell holder, in a closed position. The dumbbell holder may include fastening a first body 1 and second body 2 together and allowing them to rotate about the corresponding axis of a hinge 6. The first body 1 can thus be pivoted into an open or closed position relative to the second body 2 about the axis of the hinge 6 and in the closed position, the first inside face 12 of the first body 1 abuts the second inside face 11 of second body 2. The dumbbell holder may define a plurality of through holes 8 constructed and arranged to receive an elongated cylindrical bar (for example a barbell or barbells) of varying diameter, shape, or size. The dumbbell holder may define a semicircular elongated channel 4 constructed and arranged to receive an elongated cylindrical grip of a dumbbell.

According to variation 1, a dumbbell holder may including a first body including a first upper section defining a first elongated cylindrical through hole; a first base section; and a first intermediate section joining the first upper section and the first base section and defining a first channel. A second body may include a second upper section defining a second elongated cylindrical through hole; a second base section; a second intermediate section joining the second upper section and the second base section and defining a second channel; and at least one hinge mechanism pivotably joining the first base section and the second base section.

Variation 2 may include a dumbbell holder as in variation 1, wherein the at least one hinge mechanism is a barrel hinge including a barrel hinge pin.

Variation 3 may include a dumbbell holder as in any of variations 1 through 2, wherein the at least one hinge mechanism is a living hinge.

Variation 4 may include a dumbbell holder as in any of variations 1 through 3, wherein the at least one hinge mechanism pivotably joining the first base section and the second base section includes a first set of barrel hinges connected to the first body and a second set of barrel hinges connect to the second body.

Variation 5 may include a dumbbell holder as in any of variations 1 through 4, wherein at least one of the first elongated cylindrical through hole or second elongated cylindrical through hole are constructed and arranged to receive a bar therein.

Variation 6 may include a dumbbell holder as in any of variations 1 through 5, wherein the first gasket includes a first plurality of gaskets fins extending approximately distally inward from the first channel.

Variation 7 may include a dumbbell holder as in any of variations 1 through 6, wherein the second gasket includes a second plurality of gaskets fins extending approximately distally from the second channel.

Variation 8 may include a dumbbell holder as in any of variations 1 through 7, wherein the first plurality of gaskets fins and the second plurality of gaskets fins are constructed and arranged to elastically deform and engage a bar disposed within the first channel and the second channel.

Variation 9 may include a dumbbell holder as in any of variations 1 through 8, wherein the dumbbell holder is constructed and arranged in an approximately clamshell design such that the first body and second body pivot on the at least one hinge mechanism to enclose a portion of a dumbbell within the first channel and second channel.

Variation 10 may include a dumbbell holder as in any of variations 1 through 9, wherein the first body further including a at least one first tab and defines a at least one first indent; the second body further including a at least one second tab and defines a at least one second indent; the at least one first tab and at least one second indent including approximately complimentary profiles such that the at least one first tab is mate able within the at least one second indent; and the at least one second tab and at least one first indent including approximately complimentary profiles such that the at least one second tab is mate able within the at least one first indent.

Variation 11 may include a dumbbell holder as in any of variations 1 through 10, further including a first plurality of notches disposed within the first elongated cylindrical through hole and a second plurality of notches disposed within the second elongated cylindrical through hole.

Variation 12 may include a dumbbell holder as in any of variations 1 through 11, further including an elongated cylindrical spacer constructed and arranged to mechanically connect to at least one of the first plurality of notches or second plurality of notches.

Variation 13 may include a dumbbell holder as in any of variations 1 through 12, wherein the elongated cylindrical spacer includes spacer notches constructed and arranged to mechanically connect to at least one of the first plurality of notches or second plurality of notches.

According to variation 14, a dumbbell holder may include a first body including a first upper section defining a first elongated cylindrical through hole; a first base section; and a first intermediate section joining the first upper section and the first base section and defining a first semicircular channel. A second body may include a second upper section defining a second elongated cylindrical through hole; a second base section; and a second intermediate section joining the second upper section and the second base section and defining a second semicircular channel. The dumbbell holder may further include at least one barrel hinge including a first set of barrel hinges on the first base section, a second set of barrel hinges on the second base section, and barrel hinge pin pivotably joining the first set of barrel hinges and the second set of barrel hinges such that the first semicircular channel and the second semicircular channel may define a primary channel; a first gasket disposed within the first semicircular channel, the first gasket including at least one first elastic fin extending distally from the first semicircular channel; and a second gasket disposed within the second semicircular channel, the second gasket including at least one second elastic fin extending distally from the second semicircular channel.

Variation 15 may include a dumbbell holder as in variation 14, wherein the first elongated cylindrical through hole and the second elongated cylindrical through hole share an axis approximately perpendicular to that of the primary channel.

Variation 16 may include a dumbbell holder as in any of variations 14 through 15, wherein at least one of the first elongated cylindrical through hole or second elongated cylindrical through hole are constructed and arranged to receive a bar therein.

Variation 17 may include a dumbbell holder as in any of variations 14 through 16, wherein the first body further including a first tab and defines a first indent; the second body further including a second tab and defines a second indent; the first tab and second indent including approximately complimentary profiles such that the first tab is mate able within the second indent; and the second tab and first indent including approximately complimentary profiles such that the second tab is mate able within the first indent.

Variation 18 may include a dumbbell holder as in any of variations 14 through 17, further including a first plurality of notches disposed within the first elongated cylindrical through hole and a second plurality of notches disposed within the second elongated cylindrical through hole.

Variation 19 may include a dumbbell holder as in any of variations 14 through 17, further including an elongated cylindrical spacer constructed and arranged to mechanically connect to at least one of the first plurality of notches or second plurality of notches, the elongated cylindrical spacer including spacer notches constructed and arranged to mechanically connect to at least one of the first plurality of notches or second plurality of notches.

According to variation 20, a dumbbell holder may include a first body including a first upper section defining a first elongated cylindrical through hole and a first plurality of notches disposed within the first elongated cylindrical through hole; a first base section; and a first intermediate section joining the first upper section and the first base section and defining a first semicircular channel. A second body may include a second upper section defining a second elongated cylindrical through hole and a second plurality of notches disposed within the second elongated cylindrical through hole; a second base section; and a second intermediate section joining the second upper section and the second base section and defining a second semicircular channel. The dumbbell holder may further include at least one barrel hinge including a first set of barrel hinges on the first base section, a second set of barrel hinges on the second base section, and barrel hinge pin pivotably joining the first set of barrel hinges and the second set of barrel hinges such that the first semicircular channel and the second semicircular channel may define a primary channel having an axis approximately perpendicular to that of the first elongated cylindrical through hole and the second elongated cylindrical through hole; a first gasket disposed within the first semicircular channel, the first gasket including a first plurality of fins extending distally from the first semicircular channel; a second gasket disposed within the second semicircular channel, the second gasket including a second plurality of fins extending distally from the second semicircular channel; and an elongated cylindrical spacer constructed and arranged to mechanically connect to at least one of the first plurality of notches or second plurality of notches, the elongated cylindrical spacer including spacer notches constructed and arranged to mechanically connect to at least one of the first plurality of notches or second plurality of notches.

While numerous variations of the invention have been described, it should be apparent that modifications and variations thereto are possible, all of which fall within the true spirit and scope of this disclosure. With respect to the above description, it is to be realized that the relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present disclosure.

The above description and drawings are illustrative of modifications that can be made without departing from the present disclosure, the scope of which is to be limited only by the following claims. Therefore, the foregoing is considered as illustrative only of the principles of the disclosure.

Further, since numerous modifications and changes will be readily apparent to those skilled in the art, the disclosed dumbbell holder shall not be limited to the exact construction and operation shown and described, and accordingly, all suitable modifications and equivalents are intended to fall within the scope of the invention as claimed.

What is claimed is:

1. A dumbbell holder comprising:

a first body comprising:

a first upper section defining a first elongated cylindrical through hole;

a first base section; and a first intermediate section joining the first upper section and the first base section and defining a first channel;

a second body comprising:

a second upper section defining a second elongated cylindrical through hole;

a second base section; and a second intermediate section joining the second upper section and the second base section and defining a second channel;

at least one hinge mechanism pivotably joining the first base section and the second base section; and wherein at least one of the first elongated cylindrical through hole and the second elongated cylindrical through hole is constructed and arranged to releasably mount the dumbbell holder onto a bar.

2. The dumbbell holder as in claim 1, further comprising a first gasket comprising a first plurality of gasket fins extending approximately distally inward from the first channel.

3. The dumbbell holder as in claim 2, further comprising a second gasket comprising a second plurality of gasket fins extending approximately distally from the second channel.

4. The dumbbell holder as in claim 3, wherein the first plurality of gasket fins and the second plurality of gasket fins are constructed and arranged to elastically deform and engage a bar disposed within the first channel and the second channel.

5. The dumbbell holder as in claim 1, further comprising a first plurality of notches disposed within the first elongated cylindrical through hole and a second plurality of notches disposed within the second elongated cylindrical through hole.

6. The dumbbell holder as in claim 5, further comprising an elongated cylindrical spacer constructed and arranged to mechanically connect to at least one of the first plurality of notches or second plurality of notches.

7. The dumbbell holder as in claim 6, wherein the elongated cylindrical spacer comprises spacer notches constructed and arranged to mechanically connect to at least one of the first plurality of notches or second plurality of notches.

8. The dumbbell holder as in claim 1 wherein the at least one hinge mechanism is a barrel hinge comprising a barrel hinge pin.

9. The dumbbell holder as in claim 1 wherein the at least one hinge mechanism is a living hinge.

10. The dumbbell holder as in claim 1 wherein the at least one hinge mechanism pivotably joining the first base section and the second base section comprises a first set of barrel hinges connected to the first body and a second set of barrel hinges connected to the second body.

11. The dumbbell holder as in claim 1 wherein the dumbbell holder is constructed and arranged in an approximately clamshell design such that the first body and second body pivot on the at least one hinge mechanism to enclose a portion of a dumbbell within the first channel and second channel.

12. The dumbbell holder as in claim 1 wherein:

the first body further comprising at least one first tab and defines at least one first indent;

the second body further comprising at least one second tab and defines at least one second indent;

the at least one first tab and at least one second indent comprising approximately complimentary profiles such that the at least one first tab is configured to mate within the at least one second indent; and the at least one second tab and at least one first indent comprising approximately complimentary profiles such that the at least one second tab is configured to mate within the at least one first indent.

13. A dumbbell holder comprising:

a first body comprising:

a first upper section defining a first elongated cylindrical through hole;

a first base section; and a first intermediate section joining the first upper section and the first base section and defining a first semicircular channel;

a second body comprising:

a second upper section defining a second elongated cylindrical through hole;

a second base section; and a second intermediate section joining the second upper section and the second base section and defining a second semicircular channel;

at least one barrel hinge comprising a first set of barrel hinges on the first base section, a second set of barrel hinges on the second base section, and a barrel hinge pin pivotably joining the first set of barrel hinges and the second set of barrel hinges such that the first semicircular channel and the second semicircular channel may define a primary channel;

a first gasket disposed within the first semicircular channel; and a second gasket disposed within the second semicircular channel;

wherein at least one of the first elongated cylindrical through hole and the second elongated cylindrical through hole is constructed and arranged to releasably mount the dumbbell holder onto a bar.

14. The dumbbell holder as in claim 13, wherein the first elongated cylindrical through hole and the second elongated cylindrical through hole share an axis approximately perpendicular to that of the primary channel.

15. The dumbbell holder as in claim 13 wherein:

the first body further comprising a first tab and defining a first indent;

the second body further comprising a second tab and defining a second indent;

the first tab and second indent comprising approximately complimentary profiles such that the first tab is configured to mate within the second indent; and the second tab and first indent comprising approximately complimentary profiles such that the second tab is configured to mate within the first indent.

16. The dumbbell holder as in claim 13, further comprising a first plurality of notches disposed within the first elongated cylindrical through hole and a second plurality of notches disposed within the second elongated cylindrical through hole.

17. The dumbbell holder as in claim 16, further comprising an elongated cylindrical spacer constructed and arranged to mechanically connect to at least one of the first plurality of notches or second plurality of notches, the elongated cylindrical spacer comprising spacer notches constructed and arranged to mechanically connect to at least one of the first plurality of notches or second plurality of notches.

18. A dumbbell holder comprising:

a first body comprising:

a first upper section defining a first elongated cylindrical through hole and a first plurality of notches disposed within the first elongated cylindrical through hole;

a first base section; and a first intermediate section joining the first upper section and the first base section and defining a first semicircular channel;

a second body comprising:

a second upper section defining a second elongated cylindrical through hole and a second plurality of notches disposed within the second elongated cylindrical through hole;

a second base section; and a second intermediate section joining the second upper section and the second base section and defining a second semicircular channel;

at least one barrel hinge comprising a first set of barrel hinges on the first base section, a second set of barrel hinges on the second base section, and a barrel hinge pin pivotably joining the first set of barrel hinges and the second set of barrel hinges such that the first semicircular channel and the second semicircular channel may define a primary channel having an axis approximately perpendicular to that of the first elongated cylindrical through hole and the second elongated cylindrical through hole;

a first gasket disposed within the first semicircular channel, the first gasket comprising a first plurality of fins extending distally from the first semicircular channel;

a second gasket disposed within the second semicircular channel, the second gasket comprising a second plurality of fins extending distally from the second semicircular channel; and an elongated cylindrical spacer constructed and arranged to mechanically connect to at least one of the first plurality of notches or second plurality of notches, the elongated cylindrical spacer comprising spacer notches constructed and arranged to mechanically connect to at least one of the first plurality of notches or second plurality of notches.

* * * * *